United States Patent [19]

Hedlund et al.

[11] Patent Number: 5,074,623

[45] Date of Patent: Dec. 24, 1991

[54] TOOL FOR CUTTING SOLID MATERIAL

[75] Inventors: Jan-Gunnar Hedlund, Sandviken; Jan G. H. Åkerman, Hägersten; Bengt A. Åsberg, Gävle, all of Sweden

[73] Assignee: Sandvik AB, Sweden

[21] Appl. No.: 513,868

[22] Filed: Apr. 24, 1990

[30] Foreign Application Priority Data

Apr. 24, 1989 [SE] Sweden ..... 891482-3

[51] Int. Cl.[5] ..... E21C 35/18; B32B 15/04

[52] U.S. Cl. ..... 299/79; 51/309; 175/409; 428/698

[58] Field of Search ..... 194/79, 86; 175/409, 175/410; 428/698, 699, 469, 472; 51/295, 307, 309

[56] References Cited

U.S. PATENT DOCUMENTS 4,743,515 5/1988 Fischer et al. ..... 428/698

4,820,482 4/1989 Fischer et al. ..... 501/87 X 4,843,039 6/1989 Akesson et al. ..... 428/698 X 4,859,543 8/1989 Greenfield et al. ..... 175/409 X 4,911,503 3/1990 Stiffler et al. ..... 299/79

4,938,538 7/1990 Larsson et al. ..... 175/410

*Primary Examiner*—David J. Bagnell

*Attorney, Agent, or Firm*—Burns, Doane, Swecker & Mathis

[57] ABSTRACT

The present invention relates to a tool for cutting solid material, the tool including a tool body having a supporting surface, and a cutting insert having a generally conical tip portion and a shoulder portion that is intended to rest against a supporting surface, the cutting insert being secured to the tool body, e.g., by brazing. The invention also relates to the cutting insert per se. The cutting insert has a concave portion between its tip and bottom which concave portion extends circumferentially around the cutting insert. In addition, a special type of cemented carbide is used for the cutting insert.

22 Claims, 7 Drawing Sheets

TOOL FOR CUTTING SOLID MATERIAL

BACKGROUND OF THE INVENTION

The present invention relates to a tool for cutting solid material, said tool comprising a tool body and a cutting insert of cemented carbide, said cutting insert being secured to the tool body by brazing. The invention also relates to a cutting insert per se.

When a tool according to the present invention is cutting a relatively hard, solid material, e.g., sandstone, the cutting insert will be subjected to very high forces, said forces creating a turning moment that gives rise to tensile stresses in certain portions of the surface of the cutting tip. Also the turning moment will eventually be transformed to the brazed joint.

Cutting inserts of cemented carbide that are subjected to high bending stresses must have a high toughness, i.e., lower hardness compared to cutting inserts that are subjected basically to compressive stresses. In mineral and asphalt cutting, lateral forces are present to a relatively high degree. Therefore, cutting inserts of the type having a relatively low hardness and high Co-content are chosen for mineral and asphalt cutting. A high Co-content is also favorable in reducing brazing stresses.

The wear resistance of a cutting insert as described above consequently is low and in no way optimal as regards length of life. It is therefore common to choose big cutting inserts having a big volume of cemented carbide for mineral and asphalt cutting. By way of such an arrangement, one can handle the bending stresses and the tool also gets an acceptable length of life.

In conventional tools for mineral and asphalt cutting, the big volume cutting inserts are properly embedded in the tool blank made out of steel. Such an arrangement makes sure that the cutting insert is not subjected to too high stresses.

However, such a design means that the steel of the blank surrounding the cutting insert quite soon gets in contact with the mineral or asphalt that is worked. Especially when minerals are worked, the contact between minerals and steel will initiate sparking that can be very dangerous, e.g., in mines having inflammable gases. Contact between a cutting insert of cemented carbide and minerals will normally not initiate sparking.

Since the cemented carbide cutting insert for cutting mineral and asphalt has a relatively big volume, the tool itself is also voluminous. This means that very powerful machines are needed to carry the tools.

As mentioned above, the turning moment acting upon the cutting insert will be transferred to the brazed joint. A conventional brazed joint between the cutting insert and the tool body has normally a substantially constant thickness. This means that only a peripheral part of the brazed joint will be active in absorbing the turning moment.

Especially in mineral cutting one speaks of technically cuttable material and economically cuttable material. The technically cuttable material is the hardest material that can be worked by a cutting action. The economically cuttable material is the hardest material that can be worked by cutting action in economic superiority to other methods.

OBJECTS AND SUMMARY OF THE INVENTION

The aim of the present invention is to present a tool and a cutting insert for the cutting of mineral or asphalt, said tool/cutting insert demanding a relatively low energy to perform cutting and has a high wear resistance. A preferred embodiment of the tool has a brazed joint that to a greater degree is active in absorbing the turning moment acting upon the cutting insert. Consequently, harder material can thereby be considered economically cuttable. The tool according to the invention also to a high degree avoids sparking when working. The aim of the present invention is realized by a tool/cutting insert that has been given the characteristics of the appending claims.

In one aspect of the inspection there is provided a tool for cutting solid material, said tool including a tool body having a supporting surface, and a cutting insert having a generally conical tip portion and a shoulder portion that is intended to rest against the supporting surface, said cutting insert being secured to the tool body wherein an intermediate portion of the cutting insert, seen in axial direction of the cutting insert, includes a concave portion extending circumferentially around the cutting insert, the cutting insert comprising a core of cemented carbide, an intermediate layer of cemented carbide surrounding said core and a surface layer of cemented carbide, the surface layer, the intermediate layer and the core all containing WC (alpha-phase) with a binder phase (beta-phase) based upon at least one of cobalt, nickel or iron, the core further containing eta-phase, the intermediate layer and the surface layer being free of eta-phase, the content of binder phase in the surface layer being lower than the nominal content of binder phase for the cutting insert, and the content of binder phase in the intermediate layer being higher than the nominal content of binder phase for the cutting insert.

In another aspect of the invention there is provided a cutting insert of cemented carbide adapted to be fastened to a supporting surface of a tool body, said cutting insert having a generally conical tip portion and a shoulder portion that is intended to rest against the supporting surface, wherein an intermediate portion of the cutting insert, seen in axial direction of the cutting insert, includes a concave portion extending circumferentially around the cutting insert, the cutting insert comprising a core of cemented carbide, an intermediate layer of cemented carbide surrounding said core and a surface layer of cemented carbide, the surface layer, the intermediate layer and the core containing WC (alpha-phase) with a binder phase (beta-phase) based upon at least one of cobalt, nickel or iron, the core further containing eta-phase, the intermediate layer and the surface layer being free of eta-phase, the content of binder phase in the surface layer being lower than the nominal content of binder phase for the cutting insert, and the content of binder phase in the intermediate layer being higher than the nominal content of binder phase for the cutting insert.

BRIEF DESCRIPTION OF THE DRAWINGS

Below an embodiment of the tool according to the invention will be described with reference to the accompanying drawings, where FIG. 1 discloses a cutting drum of an excavating machine.

DETAILED DESCRIPTION OF THE PREFERRED EMBODIMENTS

Figure 1:
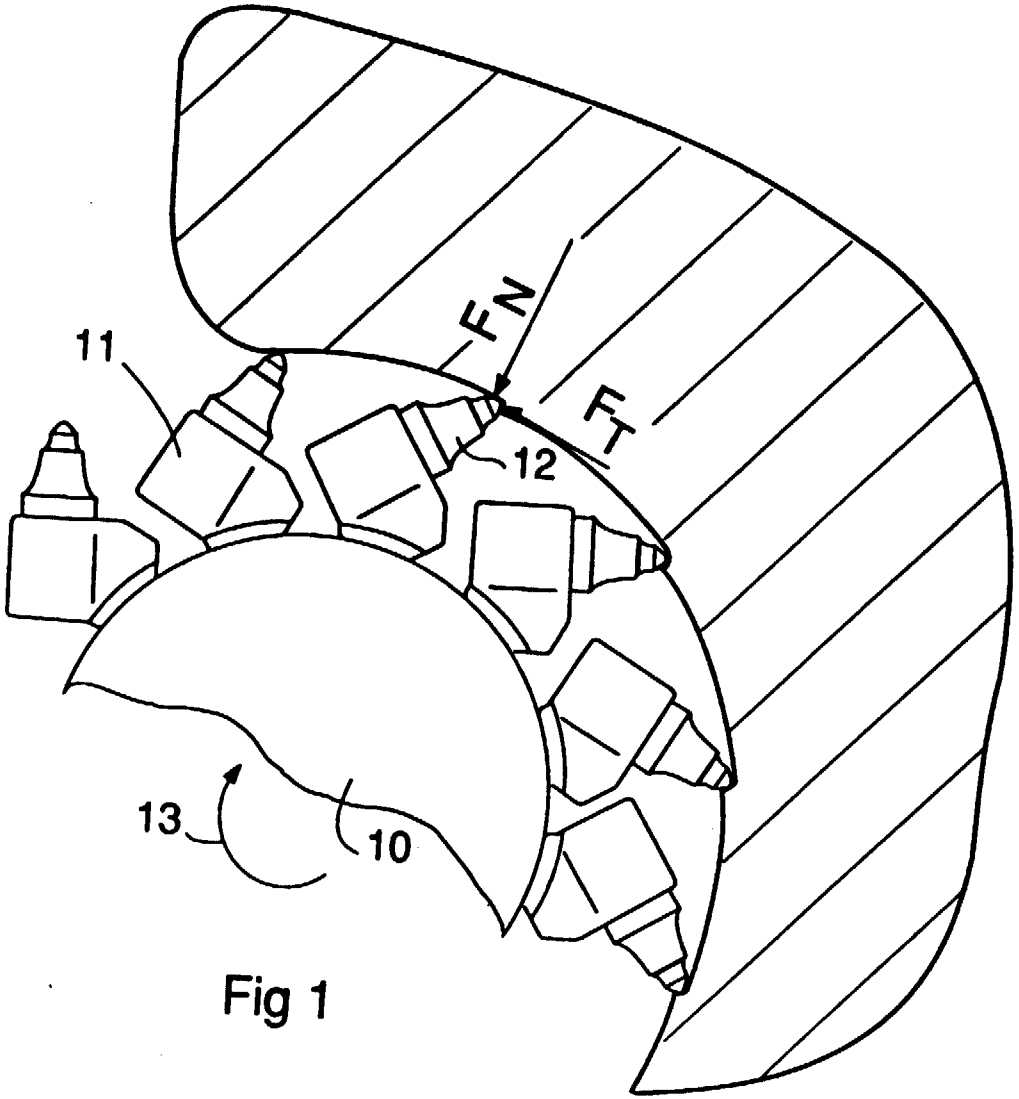

The cutting drum 10 (only partly shown) in FIG. 1 carries a number of holders 11 that each support a tool 12 for cutting solid material. The cutting drum 10 is rotated in direction of the arrow 13. When a tool 12 is in engagement with the material to be worked, the cutting insert 14 of the tool 12 is subjected to a normal force $F_N$ and a force parallel to chord $F_T$.

If very hard material is worked then the normal force $F_N$ is considerably bigger than the force parallel to chord $F_T$. The force $F_N$ can be up to four times the force $F_T$ and in such a case it is at once realized that a portion of the surface of the cutting insert 14 will be subjected to high tensile stresses.

In order to handle these high tensile stresses it is necessary to use a special type of cemented carbide disclosed in U.S. Pat. Nos. 4,743,515 and 4,820,482, the disclosures of which are herein incorporated by reference.

Figure 3:
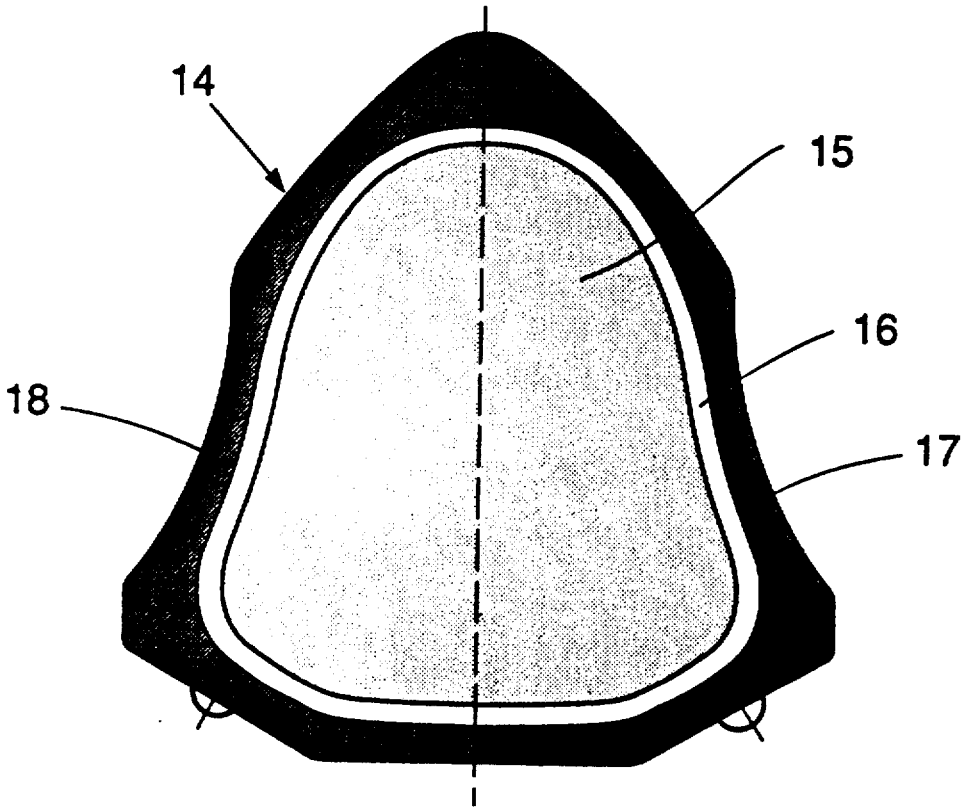
FIG. 3 shows a sectional view of a cutting insert according to the invention.

The cutting insert 14 in FIG. 3 has a core 15 of cemented carbide containing eta-phase carbide, that is, the low carbon phases of the W—C—Co system such as the $M_6C$— and $M_{12}C$-carbides and kappa phase which is approximately $M_4C$. The core 15 is surrounded by an intermediate layer 16 of cemented carbide free of eta-phase and having a high content of cobalt relative to the nominal content of cobalt in the entire insert. The surface layer 17 consists of cemented carbide free from eta-phase and having a low content of cobalt relative to the nominal content of cobalt in the entire insert. An intermediate part of the cutting insert 14 includes a concave portion 18 extending circumferentially around the cutting insert 14.

The content of eta-phase in the core of the cutting insert is 2 to 60, percent by volume and the nominal content of binder phase is from 8 to 20, preferably from 11 to 16, percent by weight.

The thickness of the surface layer 17 is 0.8–4, preferably 1–3, of the thickness of the intermediate layer 16.

The core 15 and the intermediate, cobalt rich layer 16 have high thermal expansivity compared to the surface layer 17. This means that the surface layer 17 will be subjected to high compressive stresses. The bigger the difference in thermal expansivity, i.e., the bigger the difference in cobalt content between the surface layer 17 and the rest of the cutting insert 14, the higher the compressive stresses in the layer 17. The content of binder phase in the surface layer 17 is 0.1–0.9, preferably 0.2–0.7, of the nominal content of binder phase for the cutting insert 14. The content of binder phase in the intermediate layer 16 is 1.2–3, preferably 1.4–2.5, of the nominal content of binder phase for the cutting insert 14.

Figure 4:
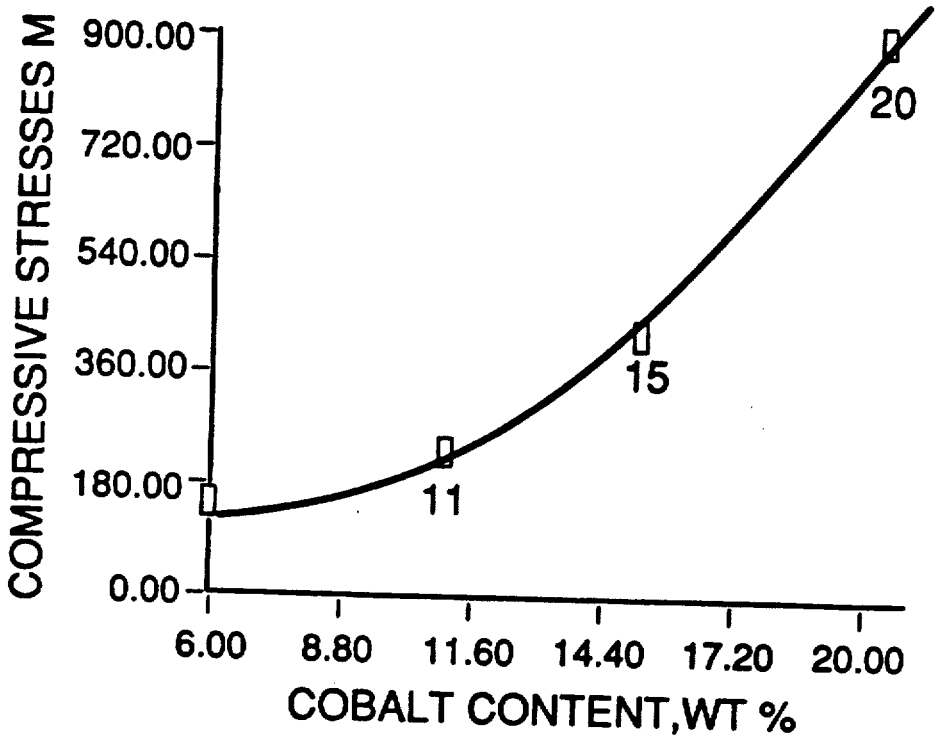
FIG. 4 shows a diagram of how the compressive stresses in the surface layer vary by varying cobalt content.

From what is said above, it can be realized that a higher nominal cobalt content of the cutting insert gives higher compressive stresses in the surface layer. This is shown by the diagram of FIG. 4.

It should be pointed out that the core 15 of cemented carbide containing eta-phase is stiff, hard and wear resistant. Said core 15 in combination with an intermediate layer 16 free of eta-phase and having a high content of cobalt and a surface layer 17 free of eta-phase and subjected to high compressive stresses presents a cutting insert 14 that fulfills the requirements discussed above for cutting of mineral and asphalt, i.e., a cutting insert demanding relatively low cutting forces and having a relatively high wear resistance.

Figure 5:
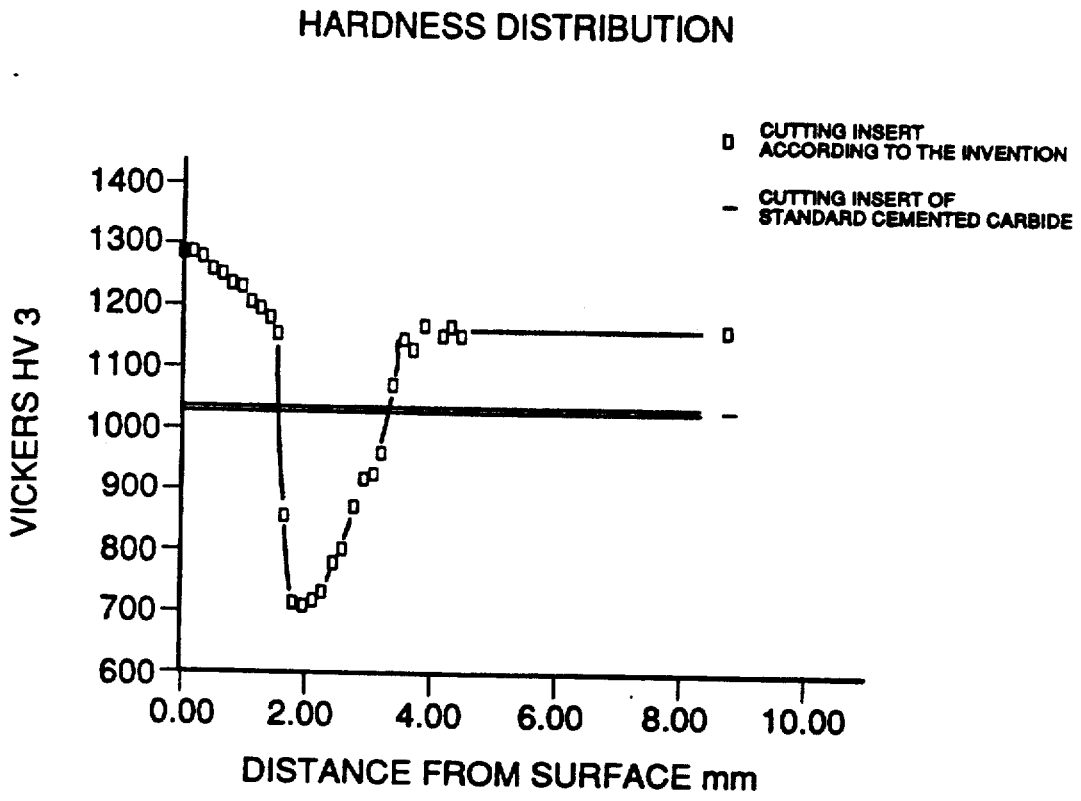
FIG. 5 shows a diagram of how the hardness varies in relation to the distance from the surface of two cutting inserts.

In FIG. 5, a diagram is disclosed showing the hardness distribution of a cutting insert according to the present invention and a cutting insert of standard cemented carbide, both inserts having a nominal content of cobalt of 15% by weight. The measurements are carried out from the surface up to the center of the cutting inserts. By studying FIG. 5 it is at once noticed that the surface layer 17 of a cutting insert according to the invention has a relatively seen very high hardness up to about 1.5 mm from the surface, said layer 17 having a low content of cobalt. The layer 16 having a high content of cobalt has a relatively low hardness. The core 15 again has a relatively high hardness.

The cutting insert of standard cemented carbide has a constant hardness, as can be seen in FIG. 5.

Tests have been made of the parameter wear relative to the parameter cutting length for three difference cutting inserts. Said tests are shown in a diagram in FIG. 6.

The cutting insert of type A has a geometrical design in accordance with FIG. 3. However, the material in said cutting insert is cemented carbide of standard type. The cutting insert of type B is of conventional geometrical design for cutting mineral, see FIG. 7, and the cutting insert of type C is a cutting insert 14 according to the present invention, i.e., in accordance with FIG. 3.

Figure 6:
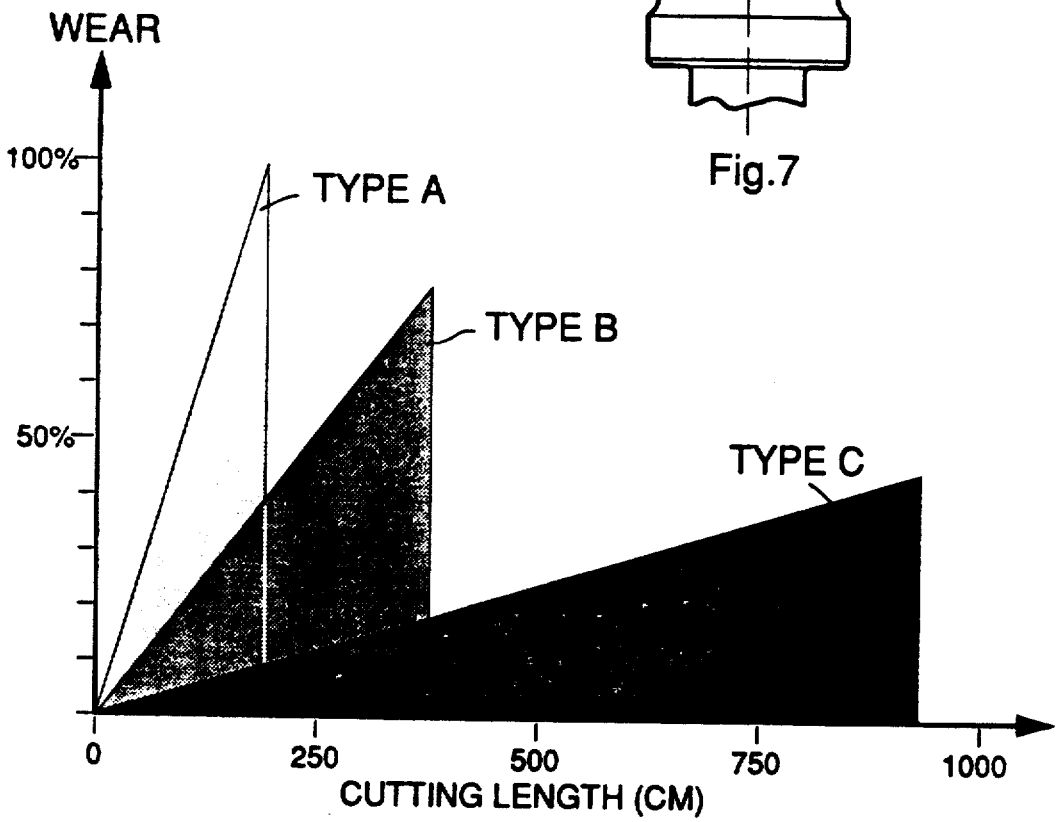
FIG. 6 shows a diagram of how the wear is related to the cutting length for a number of cutting inserts.

As can be seen from FIG. 6, the cutting insert of type A is worn out to 100% after a cutting length of about 190 m. The cutting insert of type B is worn out to about 80% after a cutting length of about 375 m. The cutting insert of type C is worn out to about 50% after a cutting length of about 940 m. In this connection it should also be pointed out that the cutting inserts of type A and C have a weight of 80 g while the cutting insert of type B has a weight of 150 g, i.e., the volume of the cutting insert of type B is almost twice the volume of the cutting inserts of type A and C.

Figure 2:
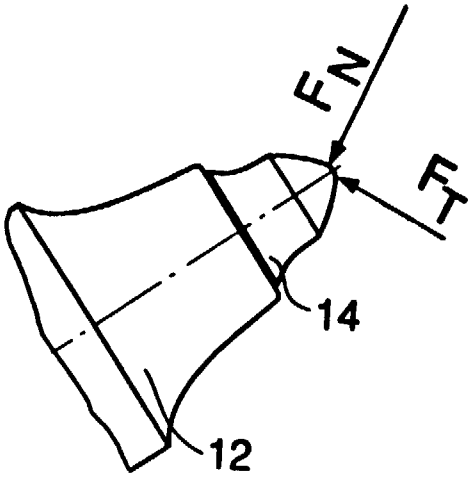
FIG. 2 discloses a detail in enlarged scale of a part of a tool carried by the drum.

For a man skilled in the art, the results presented in FIG. 6 are very surprising. Compared to conventional cutting inserts for cutting mineral or asphalt, the cutting insert according to the present invention has a relatively large axial projection, see, e.g., FIG. 2. The composition of the cutting insert 14 according to FIG. 3 makes it possible to handle the relatively large tensile stresses and bending moments that act upon the cutting insert 14 due to its relatively large axial projection.

Figure 7:
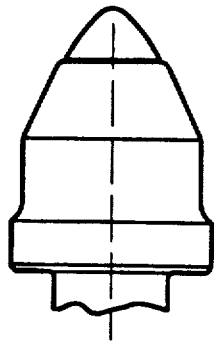
FIG. 7 shows the head of a cutting insert of type B.

A further advantage with a tool according to the present invention compared to conventional tools is that less dust is produced when cutting is effected, i.e., the grain-size distribution of the cut material is displaced towards bigger grain-sizes for the cutting insert of the present invention than for a cutting insert of type B, see FIG. 7. The reason for that is the geometry in combination with the high wear resistance of the cutting insert according to the invention.

Figure 8:
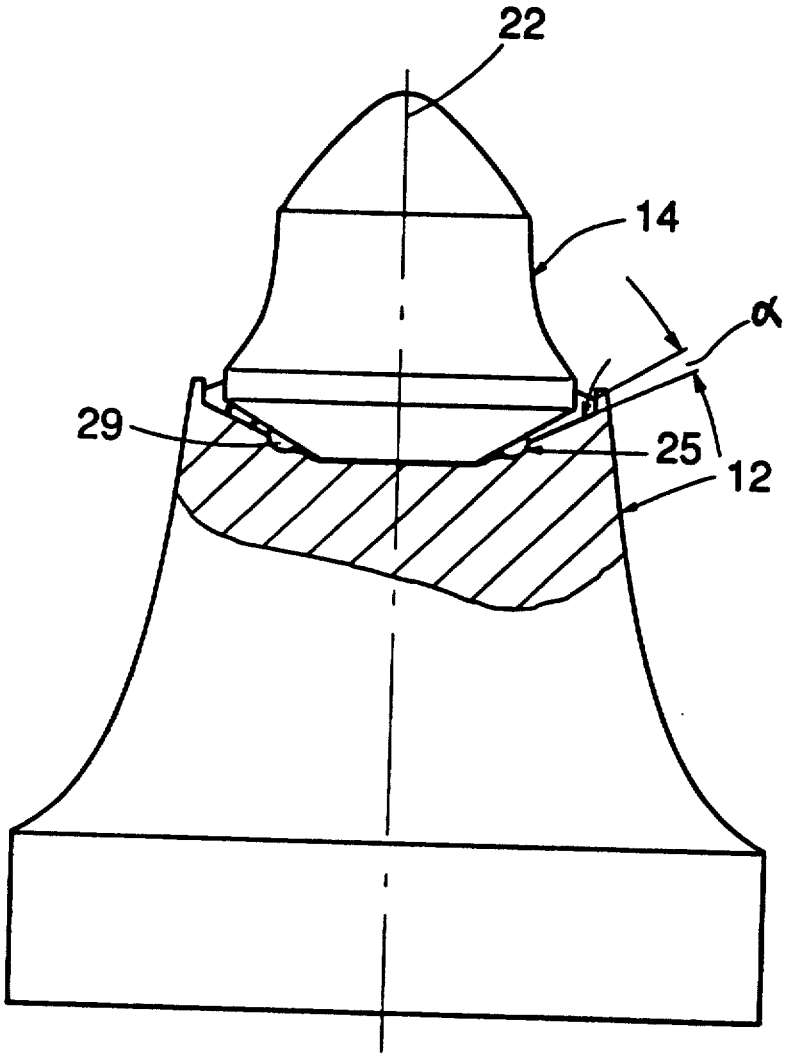
FIG. 8 shows a tool according to the invention having a preferred design of the brazed joint.
Figure 9:
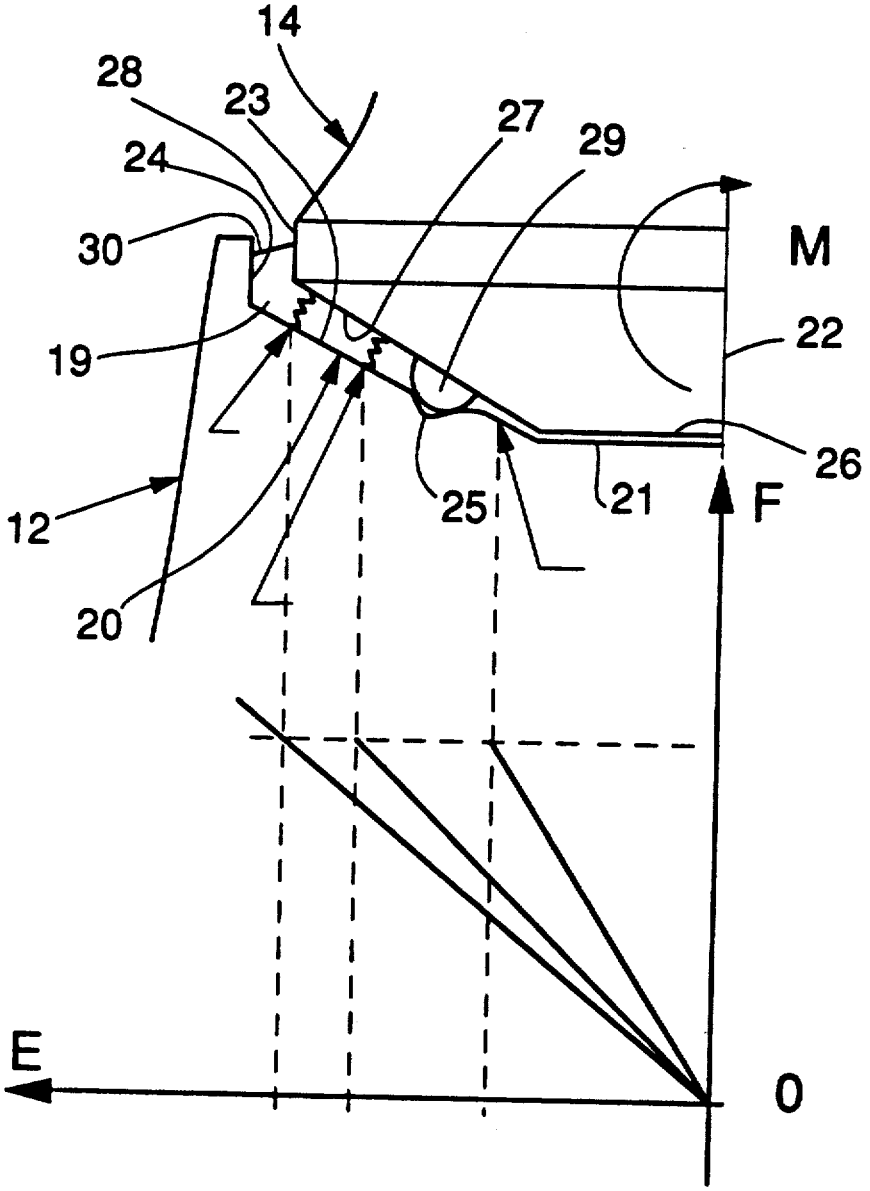
FIG. 9 shows a detail in enlarged scale of FIG. 8.

In FIG. 8 and 9 a preferred embodiment of a brazed joint 19 is disclosed. The brazed joint 19 is located between the tool body 12 and the cutting insert 14. The tool body includes a recess 20 adapted to receive the cutting insert 14.

In the described embodiment the recess 20 has a flat bottom portion 21 located in a plane perpendicular to the longitudinal center axis 22 of the tool. The recess also includes a conical surface portion 23 extending from the bottom portion 21 towards the periphery of the tool body 10. The conical portion 23 is symmetrical in respect of the longitudinal center axis 22.

The recess 20 also includes an annular surface portion 24 having an extension in the longitudinal direction of the tool.

In the conical surface portion 23 an annular groove 25 is provided, said groove 25 being used for fixation of the cutting insert 14 in the recess.

The cutting insert 14 according to the described embodiment has a flat bottom surface 26 adapted to be located above the bottom surface 21 of the recess in mounted position of the cutting insert 14.

The cutting insert 14 further includes a conical surface portion 27 extending from the bottom surface 26 up to a cylindrical periphery surface 28 of the cutting insert 14, said surface 28 defining the biggest diameter of said cutting insert 14.

The conical surface portion 27 of the cutting insert is provided with a number of spacing buttons 29 cooperating with the groove 25 in mounted position of the cutting insert 14. The buttons 29 and the groove 25 make sure that the cutting insert is in correct position before brazing takes place.

As is indicated in FIG. 8 the conical surface portion 23 of the recess 20 and the conical surface portion 27 of the cutting insert between them include an angle $\alpha$ that preferably has a value of 2°–4°. The surface portions 23 and 27 resp., diverge in direction towards the periphery of the tool.

From FIG. 9 it can be learnt that the bottom surfaces 21 and 26 resp., are at a small distance from each other in the disclosed embodiment.

When brazing is about to take place the tool body 10 and the cutting insert 14 are oriented relative to each other as is shown in FIGS. 8 and 9, i.e., they have a common longitudinal center axis 22.

Brazing is then effected and preferably a copper based brazing alloy is used. It is also preferred to use vacuum brazing. The upper surface of the brazed joint 19 is marked by 30 in FIG. 9.

Due to the included angle $\alpha$ between the conical surface portions 23 and 27 resp., the brazed joint 19 has generally wedge-like cross-sections in an axial plane through the tool according to the invention. The thickness of the brazed joint 19 is increasing towards the periphery of the cutting insert 14.

This described design of the brazed joint 19 is Very effective in that almost the entire portion of the brazed joint 19 located between the conical surface portions 23 and 27 resp., is active in absorbing the turning moment acting upon the cutting insert 14. At one side the brazed joint 19 will be subjected to tension forces while the diametrically opposed side will be subjected to compression forces. The most difficult forces to handle are of course the tension forces.

In order to describe the function of the brazed joint according to the present invention it could be looked upon as a number of elastical springs 31, 32, and 33. In such a case the in radial direction outer portion of the brazed joint will be more extended/compressed than the inner portions. Although the springs 31–33 are extended/compressed to a different degree they exert substantially the same force due to their different lengths. This is illustrated by the diagram in FIG. 9. The vertical axis indicates the force F and the horizontal axis indicates the extension E. The disclosed brazed joint of FIG. 9 is subjected to a turning moment M and it is realized at once that the springs 31–33 are subjected to tension forces that in a conventional way are negative in the diagram. The tension force in each spring 31–33 is the same while the extensions are different. Of course this theory will not be fulfilled completely in practice but the principle is important.

A preferred but non-limiting dimensional example of the brazed joint can be given. In the area of spring 31 the brazed joint can have a thickness of 0.7 mm and in the area of spring 33 the thickness is 0.3 mm. The diameter of the cutting insert 14 is 24 mm measured at the cylindrical periphery surface 28.

In this connection it should be pointed out that the brazed joint described above is not limited to be used with a cutting insert 14 according to the present invention. Also the rest of the invention is of course not restricted to the described embodiments but can be varied freely within the scope of the appending claims.

We claim:

1. A tool for cutting solid material, said tool including a tool body having a supporting surface, and a cutting insert having a generally conical tip portion and a shoulder portion that is intended to rest against the supporting surface, said cutting insert being secured to the tool body wherein an intermediate portion of the cutting insert, seen in axial direction of the cutting insert, includes a concave portion extending circumferentially around the cutting insert, the cutting insert comprising a core of cemented carbide, an intermediate layer of cemented carbide surrounding said core and a surface layer of cemented carbide, the surface layer, the intermediate layer and the core all containing WC (alpha-phase) with a binder phase (beta-phase) based upon at least one of cobalt, nickel or iron, the core further containing eta-phase, the intermediate layer and the surface layer being free of eta-phase, the content of binder phase in the surface layer being lower than the nominal content of binder phase for the cutting insert, and the content of binder phase in the intermediate layer being higher than the nominal content of binder phase for the cutting insert.

2. The tool of claim 1, wherein the content of eta-phase in the core of the cutting insert is 2–60% by volume.

3. The tool of claim 2, wherein the content of the eta-phase in the core of the cutting insert is from 10–35% by volume.

4. The tool of claim 1, wherein the nominal content of binder phase in the cutting insert is 8–20% per weight.

5. The tool of claim 4, wherein the nominal content of binder phase in the cutting insert is from 11–16% by weight.

6. The tool of claim 1, wherein the content of binder phase in the surface layer is 0.1–0.9 of the nominal content of binder phase for the cutting insert, and that the content of binder phase in the intermediate layer is 1.2–3 of the nominal content of binder phase for the cutting insert.

7. The tool of claim 6, wherein the content of the binder phase in the surface level is from 0.1–0.9 of the nominal content of the binder phase in the intermediate layer is 1.4–2.5 of the nominal content of binder phase for the cutting insert.

8. The tool of claim 1, wherein the thickness of the surface layer is 0.8–4 of the thickness of the intermediate layer.

9. The tool of claim 8, wherein the thickness of the surface layer is from 0.8 –4 of the thickness of the intermediate layer.

10. The tool of claim 1, wherein the cutting insert is secured to the tool body by brazing.

11. The tool of claim 10, wherein the joint formed by brazing between the cutting insert and the tool body has at least partially an increasing thickness in direction from the center of the cutting insert towards the periphery of the cutting insert.

12. The tool of claim 11, wherein the brazed joint has generally wedge-like cross-sections in an axial plane of the tool.

13. A cutting insert of cemented carbide adapted to be fastened to a supporting surface of a tool body said cutting insert having a generally conical tip portion and a shoulder portion that is intended to rest against the supporting surface, wherein an intermediate portion of the cutting insert, seen in axial direction of the cutting insert, includes a concave portion extending circumferentially around the cutting insert, the cutting insert comprising a core of cemented carbide, an intermediate layer of cemented carbide surrounding said core and a surface layer of cemented carbide, the surface layer, the intermediate layer and the core containing WC (alpha-phase), with a binder phase (beta-phase) based upon at least one of cobalt, nickel, or iron, the core further containing eta-phase, the intermediate layer and the surface layer being free of eta-phase, the content of binder phase in the surface layer being lower than the nominal content of binder phase for the cutting insert, and the content of binder phase in the intermediate layer being higher than the nominal content of binder phase for the cutting insert.

14. The cutting insert according to claim 13, wherein the content of eta-phase in the core is 2–60% by volume.

15. The cutting insert according to claim 14, wherein the content of the eta-phase in the core is 10–35% by volume.

16. The cutting insert according to claim 13, wherein the nominal content of binder phase is 8–20% per weight.

17. The cutting insert according to claim 16, wherein the nominal content of binder phase is 11–16% by weight.

18. The cutting insert according to claim 13, wherein the content of binder phase in the surface layer is 0.1–0.9 of the nominal content of binder phase for the cutting insert, and that the content of binder phase in the intermediate layer is 1.2–3 of the nominal content of binder phase for the cutting insert.

19. The cutting insert according to claim 18, wherein the content of binder phase in the surface layer is 0.2–0.7 and the content of binder phase in the intermediate layer is 1.4–2.5 each of the nominal content of binder phase for the cutting insert.

20. The cutting insert according to claim 13, wherein the thickness of the surface layer is 0.8–4, of the thickness of the intermediate layer.

21. The cutting insert according to claim 20, wherein the thickness of the surface layer is 1–3 of the thickness of the intermediate layer.

22. The cutting insert according to claim 13, wherein the insert is fastened to the tool body by brazing.

* * * * *